US005689289A

United States Patent [19]

Watanabe et al.

[11] Patent Number: 5,689,289

[45] Date of Patent: Nov. 18, 1997

[54] IMAGE RECORDING APPARATUS

[75] Inventors: Naoya Watanabe, Yokohama; Makoto Kobayashi, Tama; Junji Iguchi, Musashino; Yasuyuki Shinada; Yukio Nohata, both of Yokohama; Yuji Shimahara, Kawasaki, all of Japan

[73] Assignee: Canon Kabushiki Kaisha, Tokyo, Japan

[21] Appl. No.: 348,223

[22] Filed: Nov. 28, 1994

[30] Foreign Application Priority Data

| | | | |
|---|---|---|---|
| Nov. 30, 1993 | [JP] | Japan | 5-299915 |
| Mar. 10, 1994 | [JP] | Japan | 6-039856 |

[51] Int. Cl.[6] ..... B41J 2/195; B41J 2/205

[52] U.S. Cl. ..... 347/7; 347/15; 347/19

[58] Field of Search ..... 347/3, 9, 14, 15, 347/40, 41, 43, 7; 358/502

[56] References Cited

U.S. PATENT DOCUMENTS

| | | | |
|---|---|---|---|
| 4,313,124 | 1/1982 | Hara | 347/56 |
| 4,345,262 | 8/1982 | Shirato et al. | 347/56 |
| 4,459,600 | 7/1984 | Sato et al. | 347/56 |
| 4,463,359 | 7/1984 | Ayata et al. | 347/56 |
| 4,558,333 | 12/1985 | Sugitani et al. | 347/56 |
| 4,608,577 | 8/1986 | Hori | 347/56 |
| 4,723,129 | 2/1988 | Endo et al. | 347/56 |
| 4,740,796 | 4/1988 | Endo et al. | 347/56 |
| 4,748,453 | 5/1988 | Lin et al. | 347/41 |
| 5,353,052 | 10/1994 | Suzuki et al. | 347/19 |
| 5,359,355 | 10/1994 | Nagoshi et al. | 347/9 |

FOREIGN PATENT DOCUMENTS

| | | | |
|---|---|---|---|
| 4313605 | 10/1993 | Germany | 347/3 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A standard print mode or a thinning print mode can be selected at will by an input from an operation panel to record image data received by a receiving means section in a selected print mode using an ink jet recording head, And after one page of image recording, a footer mark is recorded on the trailing portion of the recording paper, and sensed by a photo sensor to determine whether or not the ink is present. This footer mark is recorded in the standard print mode without regard to the selected print mode. Thereby, the false detection of the predetermined image recorded on the recording medium, after a predefined amount of image data has been recorded, can be prevented.

8 Claims, 9 Drawing Sheets

IMAGE RECORDING APPARATUS

BACKGROUND OF THE INVENTION

1. Field of the Invention

The present invention relates to an image recording apparatus with a plurality of recording modes which are different in recording density.

2. Related Background Art

Typically, among the ink jet recording apparatuses, an ink jet recording apparatus of the cartridge type having a recording head and an ink tank integrated together is well known. This ink jet recording apparatus has a plurality of print modes, among which there is a mode of thinning out black dot data from the print data, whereby if the user makes the setting of this print mode on the ink jet recording apparatus, the consumption of ink can be suppressed, and the running cost reduced.

In the ink jet recording apparatus, when the ink within a cartridge is used up, the user is informed and prompted to replace the cartridge, for which there is well known an ink jet recording apparatus having means of printing a predetermined image, e.g., a black mark, on the recording paper, and determining whether or not the ink is present through the optical sensing in black and white by a photo sensor.

However, if a predetermined mark indicating the presence or absence of ink is printed in the thinning print mode, the density of the mark is lower, causing a problem that a black mark may be erroneously sensed as white depending on the performance of a photo sensor.

SUMMARY OF THE INVENTION

The present invention has been achieved in the light of the aforementioned problem, and its object is to provide an improved image recording apparatus.

Further, it is another object of the present invention to provide an image recording apparatus which can sense a predetermined image such as a mark correctly, without regard to the set recording mode.

Further, it is another object of the present invention to provide an image recording apparatus which can prevent false detection of a predetermined image in such a way that even if a second recording mode with a lower recording density has been selected, the predetermined image which is recorded on the recording medium after recording of a predefined amount of image is recorded in a first recording mode which has a higher recording density than the second recording mode.

Further, it is another object of the present invention to provide an image recording apparatus having a first recording mode of recording the image on a recording medium at a predetermined recording density, and a second recording mode of recording the image on the recording medium at a lower recording density than said first recording mode, the image recording apparatus comprising selecting means for selecting said first recording mode or said second recording mode, recording control means for controlling a predetermined image to be recorded on the recording medium after recording a predefined amount of image in said first recording mode or said second recording mode which is selected by said selecting means, detecting means for detecting said predetermined image, and processing means for performing a predetermined process based on a detected result of said detecting means, wherein said recording control means controls said predetermined image to be recorded in said first recording mode, without regard to the recording mode selected by said selecting means.

The above and other objects of the invention will be more apparent from the following description and with reference to the drawings.

DETAILED DESCRIPTION OF PREFERRED EMBODIMENTS

Figure 1:
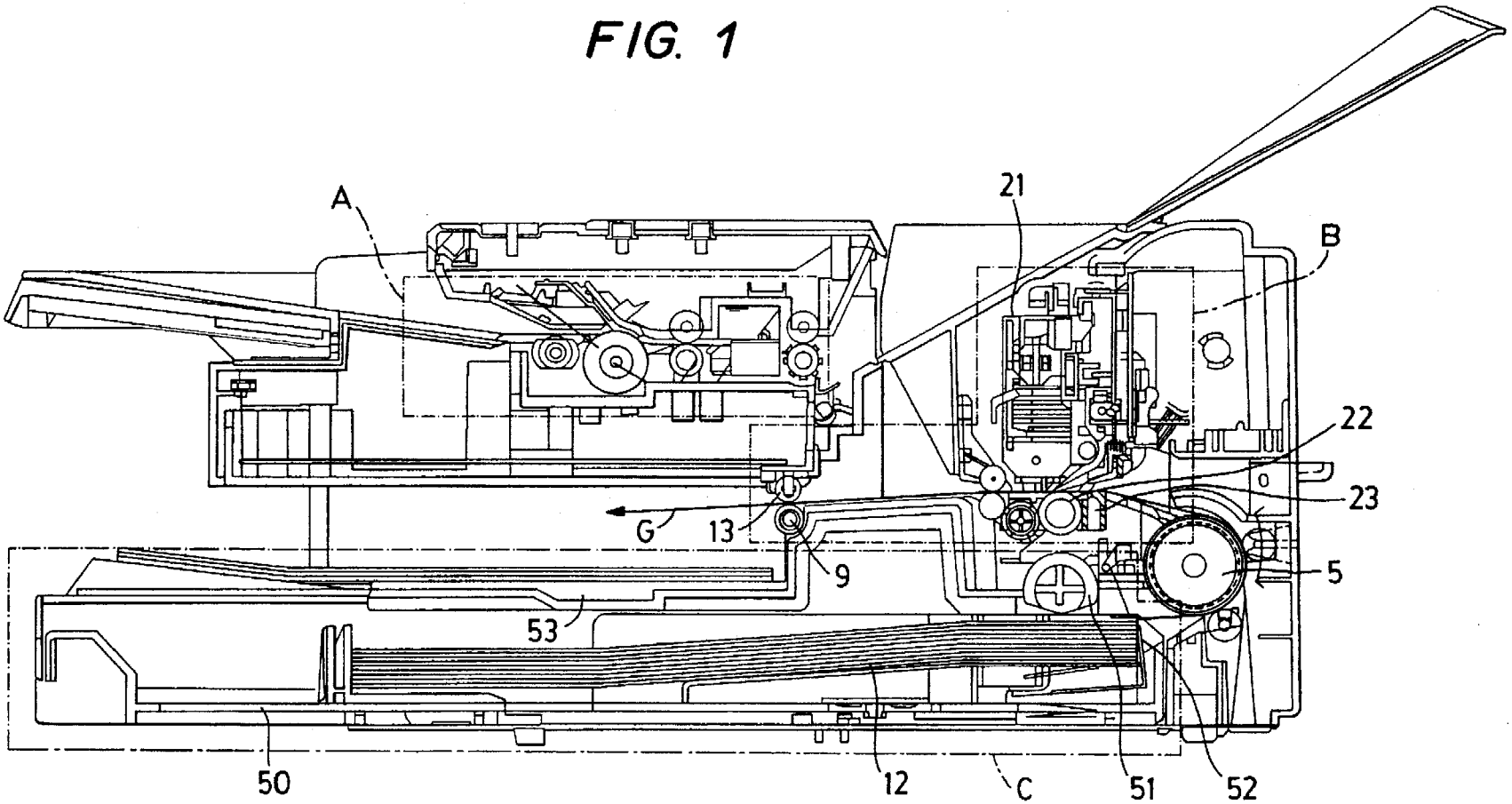
FIG. 1 is a cross-sectional view showing the schematic constitution of a facsimile apparatus having a printer unit of the ink jet system.

The preferred embodiments of the present invention will be described in detail with reference to the drawings. FIG. 1 is a cross-sectional view showing a facsimile apparatus to which the present invention is applied. In FIG. 1, A is a recording unit for reading optically the original, B is a recording unit which is an ink jet recording apparatus, and C is a paper supply unit for supplying separately a recording paper from a recording paper cassette which contains recording papers therein.

In this figure, the flow of recording paper will be outlined. A series of recording paper conveyance paths is indicated by arrow G, a recording paper 12 loaded on the recording paper cassette 50 is first picked up by a paper supply roller 51 and a separation claw 52, and conveyed by a conveying roller 5 into the recording unit. In the recording unit, the recording head 21 is reciprocated in a direction perpendicular to the paper face for the main scan to effect the recording, the recording paper, after being conveyed a certain distance within the apparatus, being ejected into a paper ejecting stacker 53 by a paper ejecting roller 9 and stacked therein. On a shaft of the paper ejecting roller 9, a photo sensor 13 is disposed to sense the emptiness of ink in the recording head and recording paper jam near the paper ejecting roller.

Figure 2:
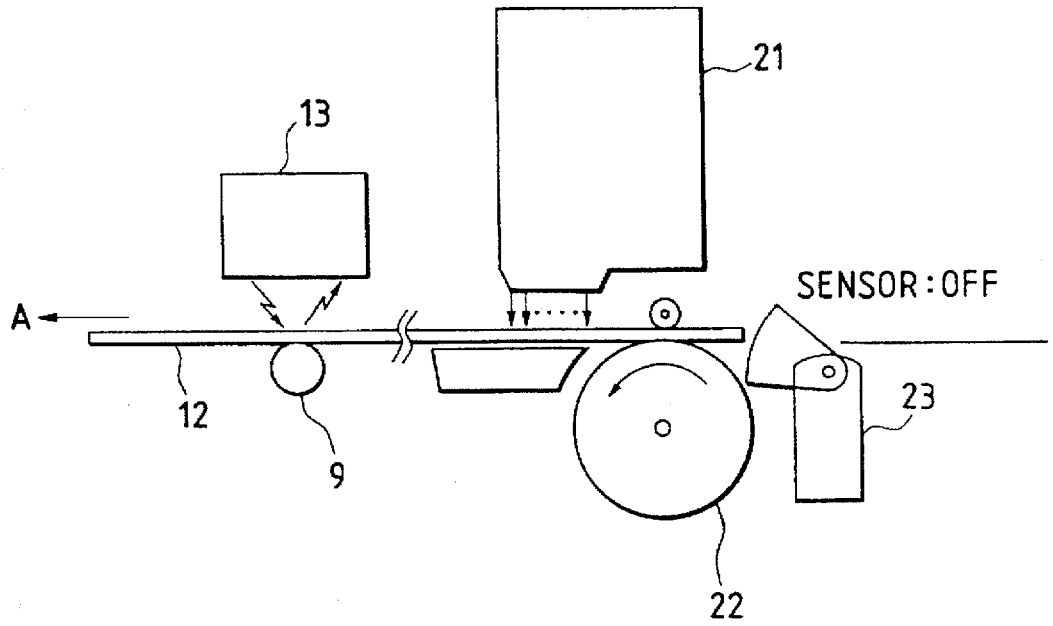
FIG. 2 is a view showing the constitution of a recorder of the facsimile apparatus as shown in FIG. 1.

FIG. 2 is a view showing the schematic constitution of a recorder unit B of the facsimile apparatus as shown in FIG. 1. In FIG. 2, 21 is a recording head, which is, in this embodiment, an ink jet recording head of the cartridge type of containing an ink tank and replaceable with a new recording head as a whole when the ink is emptied.

The recording head 21 used in this embodiment is a recording head of the ink jet system having a resolution of 360 dpi, with a column of 64 nozzles arranged in a sub-scan direction (a direction of the arrow A), whereby ink droplets are discharged through discharge orifices at the nozzle top end due to a pressure of film boiling caused in the ink by the heating of electricity-heat converters provided within the nozzles.

The recording head 21 is reciprocated in a direction normal to the conveying direction (sub-scan direction) of the recording paper 12, namely, a main scan direction (a direction perpendicular to the paper face), by a carriage, not shown, to make the scan for recording in both forward and backward movement.

Reference numeral 22 is a recording paper conveying roller, which can convey the recording paper at an accuracy of 360 dpi to make the positioning in a sub-scan direction, when supplying or ejecting the recording paper, and executing the recording with the recording head 21. Reference numeral 23 is a recording paper sensor, which is turned on if there is any recording paper in a sensing portion of this sensor, or otherwise turned off. This recording paper sensor 23 allows for the sensing of the presence or absence of the recording paper and the leading or trailing edge thereof. Reference numeral 13 is a reflection-type photo sensor for sensing the density of image on the recording face of the recording paper. In this embodiment, after one page of image recording, this sensor senses the image density of a predetermined pattern (black mark) recorded at the trailing portion of the recording paper, to check for the presence or absence of the ink or the conveyance failure of the recording paper from the sensed result. This photo sensor is comprised of an LED and a phototransistor, which is turned off in the highly black portion such as a portion where image is recorded, because there is less reflecting light of LED, or otherwise turned on in the highly reflective portion such as a ground color of the recording paper. An LED light source must be selected in accordance with the material of the ink, because the ink has different absorbing wavelengths with the material of the ink. In this embodiment, a red LED is employed because the ink having a high absorptance to red wavelength is employed. Also, the photo sensor is located near a paper ejecting opening on the scheme, and unaffected by the external light. The paper ejecting roller 9 is made of rubber or the like, and when no recording paper is on the paper ejecting roller 9, the photo sensor 13 is turned off.

Figure 3:
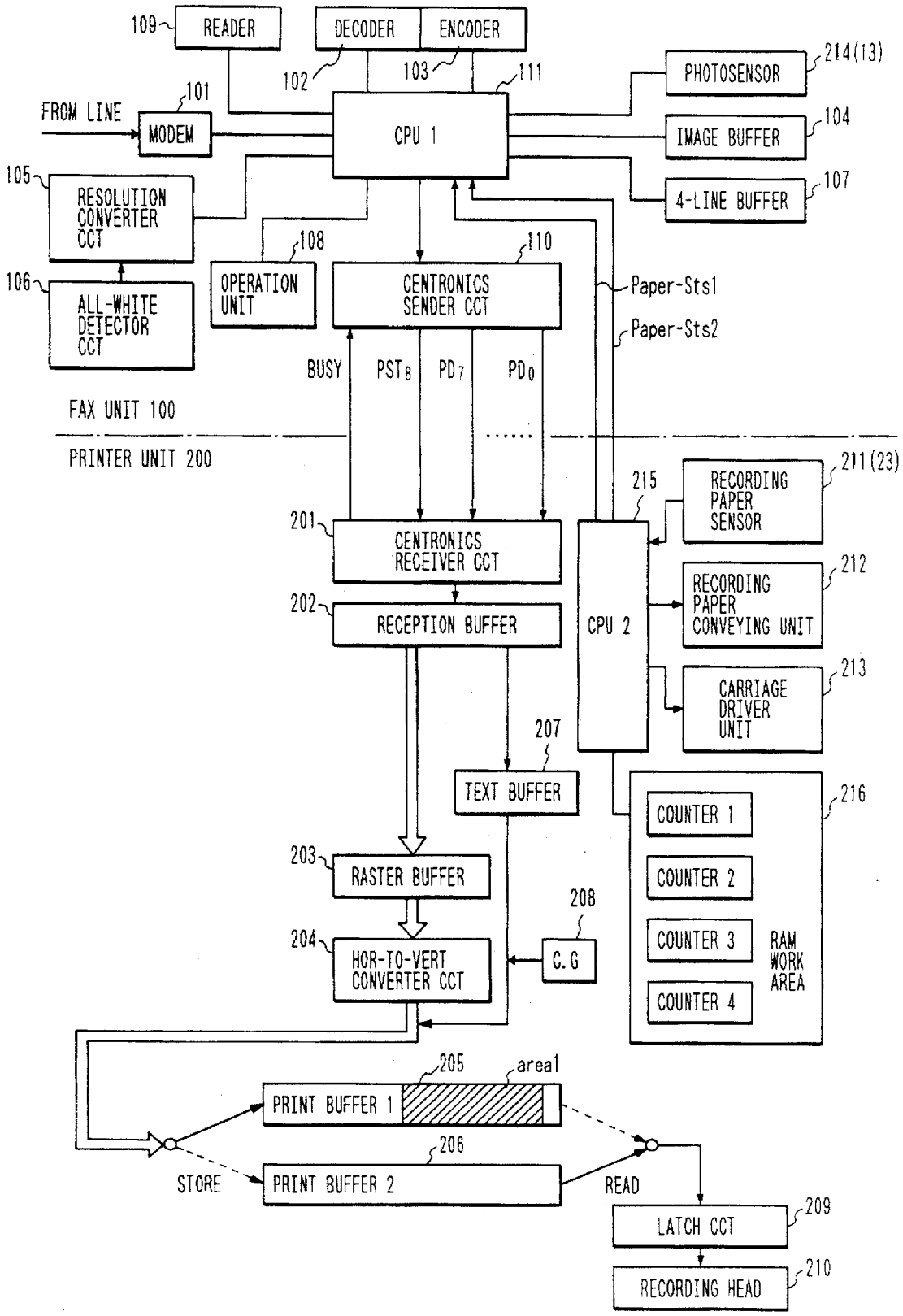
FIG. 3 is a block diagram showing the electrical configuration of the facsimile apparatus as shown in FIG. 1.

FIG. 3 is a block diagram representing the electrical configuration of the facsimile apparatus as shown in FIGS. 1 and 2, mainly regarding the flow of data. The facsimile apparatus in this embodiment is comprised of a facsimile unit 100 and a printer unit 200, the data transfer from the facsimile unit 100 to the printer unit 200 being made via a centronics interface. The facsimile unit is first described below. In the figure, 101 is a modem serving for the transmission and reception of image data via the telephone line, 102 is a decoder for decoding received data, 103 is an encoder for encoding image data, 104 is an image buffer for storing image data, 105 is a resolution converter circuit for making resolution conversion of image data stored in the image buffer 104,106 is an all-white detector circuit for detecting that data of one line is all white, and 107 is a 4-line buffer which can store line data of four lines converted in resolution by the resolution converter circuit 105, two lines used for the storage of data before conversion of resolution, and remaining two lines used for the storage of data after conversion of resolution. Reference numeral 108 is an operation unit (or console unit) having various function keys and indicators, 109 is a reader for reading the original image in sending and copying, 110 is a centronics sender circuit for sending line data stored in the 4-line buffer 107 to the printer unit 200, and 111 is a control unit (CPU1) for controlling the operation of the facsimile unit 100.

The printer unit 200 will be described below. Reference numeral 201 is a centronics reception circuit for receiving data sent from the centronics sender circuit 110, 202 is a receiver buffer for temporarily storing data received by the centronics reception circuit 201, 203 is a raster buffer for decoding data stored in the receiver buffer 202 through programmed processing and storing decoded line data, 204 is a horizontal-to-vertical converter circuit for converting line data stored in the raster buffer 203 to vertical data, and 205, 206 is a printer buffer for storing data output from the horizontal-to-vertical converter circuit 204, having a data storage capacity corresponding to the area to be recorded by a single main scan of the recording head.

Reference numeral 207 is a text buffer for storing character code data to be sent by the facsimile unit 100 when outputting a communication management report, 208 is a character generator for converting character code stored within the text buffer 207 into dot image which is then sent to the print buffer 205 or 206, 209 is a latch circuit for latching data read from the print buffer 205 or 206, and 210 is a recording head for discharging ink droplets by being driven in accordance with data latched in the latch circuit 209 (corresponding to the recording head 21 as shown in FIGS. 1 and 2).

Reference numeral 211 is a recording paper sensor for sensing the recording paper immediately before the recording position of the recording head (corresponding to the recording paper sensor 23 as shown in FIGS. 1 and 2), 212 is a recording paper conveying unit comprised of a pulse motor for generating the driving force for conveying rollers 5, 22 and paper ejecting roller 9, 213 is a carriage driver unit comprised of a pulse motor for generating the driving force to reciprocate the carriage with respect to the recording paper, 214 is a photo sensor for sensing the black mark recorded at the trailing portion of the recording paper (corresponding to the photo sensor 13 as shown in FIGS. 1 and 2), and 215 is a control unit (CPU2) for controlling the data transfer processing of the printer unit 200 and the operation of load.

Data transfer from the facsimile unit 100 to the printer unit 200 is effected via signal lines $PD_0$ to $PD_7$ between the centronics sender circuit 110 and the centronics reception circuit 201 at the timings synchronous with the pulse signal generated in a signal line $PST_B$. This data transfer is enabled when a signal line BUSY is off. Also, a signal Paper_Sts1, Paper_Sts2 corresponding to the position of the recording paper as will be described later is output from the CPU2 of the printer unit 200 to the CPU1 of the facsimile unit 100. Also, the output of the photo sensor 214 is input into the CPU1 of the facsimile unit 100.

The operation will be now described. Received data is demodulated by the modem 101, decoded by the decoder 102 and expanded into dot image data, which is checked for a communication error. Thereafter, this dot image data is encoded again by the decoder 103, and stored in the image buffer 104. And encoded data stored in this image buffer 104 is read sequentially again, decoded through the programmed processing of the CPU1 (111), and expanded into dot image data of one line, which is stored in the 4-line buffer 107. This dot image data is sent to the resolution converter circuit 105 for the resolution conversion, and stored in remaining two lines of the 4-line buffer 107. Then, the all-white detector circuit 106 is operated to check to see if data of one line stored is all white. If so, it informs the CPU1 (111) that data is all white, whereby the CPU1 sends a command indicating that data of one line is all white to the centronics sender circuit 110, and then deletes the data of one line within the 4-line buffer 107 to prepare for the next data. If not, image data converted in resolution which exists within the 4-line buffer 107 is directly sent.

If data of at least one line is stored in the 4-line buffer 107, the CPU1 checks the BUSY signal, wherein if the BUSY signal is off, data converted in resolution and stored in the 4-line buffer 107 is sent via the centronics sender circuit 111 and the centronics reception circuit 201 to the receiver buffer 202. This BUSY signal is off if the receiver buffer 202 is empty. Accordingly, data transfer from the 4-line buffer 107 to the receiver buffer 202 is effected if the receiver buffer 202 is empty. Also, data transfer from the image buffer 104 to the 4-line buffer 107 is effected if there is an empty area of at least one line in the 4-line buffer 107.

This resolution conversion is performed to make the resolution of image data consistent with the recording resolution because the resolution of received image is different from the recording resolution (360 dpi×360 dpi).

Next, the flow of data in the printer unit 200 will be described. As previously described, data sent via the centronics interface from the facsimile unit 100 is temporarily stored in the receiver buffer 202 comprised of a RAM. Herein, data stored in the receiver buffer 202 is dot image data of one line converted into a desired resolution (360 dpi) by the resolution converter circuit 105 and a command. The CPU2 (215) checks the contents of the receiver buffer 202. For the image data, it is read from the receiver buffer 202 and transferred to the raster buffer 203. Also, for the command, its content is interpreted. If the command is a command indicating that data of one line is all white, data is not stored in a corresponding storage area of the raster buffer 203, but the next image data is stored in the storage area of the next line.

Herein, the raster buffer 203 is a memory having a capacity of 8 lines (8×3640 bits). If data of 8 lines is stored in this raster buffer 203, data from the leftmost end of the raster buffer 203 is sent in sequence to the horizontal-to-vertical converter circuit 204 for the horizontal-to-vertical conversion, and transferred to either the print buffer 1 (205) or the print buffer 2 (206). The print buffers 1, 2 are both memories having a storage capacity (64×3640 bits) corresponding to data amount recorded by a single scan of the recording head 21, one of them being used for the reading (recording) while the other is used for the storage of data for the next scan.

The CPU2 counts the number of horizontal-to-vertical conversions for data of 8 lines, if 8 counts are made, i.e., the horizontal-to-vertical conversion for data of 64 lines is ended, a print start signal is output, judging that data of one main scan is prepared, to start the movement of carriage, and the recording operation based on data stored in the print buffer 1 (205) or the print buffer 2 (206). And data is sent to the latch circuit 209 each 64 dots, whereby the discharge heaters of the recording heads 210 are driven for the recording in accordance with data latched in the latch circuit 209. Meanwhile, the next main scan data is stored in the other print buffer.

The CPU2 predetects that the black data within the print buffer is stored from which address to which address, and if the data up to the final address has been transferred, ends the scan for recording, and switches the print buffer, so that the print buffer used for the data storage is made for the recording, and the print buffer used for the recording made for the data storage.

Next, the actual recording operation and the transfer timing of data from the receiver buffer 202 to the print buffer 205 or 206 will be described below. First, image data is transferred from the facsimile unit 100, its data being stored in the receiver buffer 202. The work area of a RAM 216 has set a counter 1 for counting the number of lines stored in the raster buffer 203, and every time the CPU2 stores data of one line in the raster buffer 203, increments the counter 1 and judges whether or not the count value of the counter 1 reaches 8. Data transfer from the receiver buffer 202 to the raster buffer 203 is continued until the count value of the counter 1 reaches 8. And upon the count value of the counter 1 reaching 8, data transfer from the receiver buffer 202 to the raster buffer 203 is interrupted, and further the horizontal-to-vertical conversion is made for data within the raster buffer 203 in sequence from the left end, its data being stored in the print buffer 1 (205). The work area of RAM has also set a counter 2 for counting the number of horizontal-to-vertical conversions executed, whereby the CPU2 increments the counter 2 every time the horizontal-to-vertical conversion of data of 8 lines is executed, and judges whether or not the count value of the counter 2 reaches 8. Data transfer of 8 lines from the receiver buffer 202 to the raster buffer 203 and data transfer from the raster buffer 203 to the print buffer 1 (205) are repeated until the count value of the counter 2 reaches 8, namely, until the storage of data of 64 lines is ended. Herein, the counter 2 is only necessary to count a count value of at most 8, which is much simpler than counting the number of data for one main scan (64×3640).

If the count value of the counter 2 reaches 8, the CPU2 generates a recording start signal to effect the recording of data at the first scan stored in the print buffer 1. Herein, prior to the recording, the CPU2 predetects that the black data among data stored in the print buffer 1 (205) exists from which address in what width (see area 1 on FIG. 3), which data are stored in a predetermined region of RAM 216, wherein the print buffers 1, 2 have a relation that its address corresponds one-to-one to the position on the scan region performed by the recording head 20. Also, the position of the recording head 210 is judged, with reference to a home position, not shown, in accordance with the count value of a counter 4 for counting the number of pulses supplied to a carriage driving pulse motor of a carriage drives unit 213. That is, when moving in a direction away from the home position, the count value of the counter 4 for counting the number of pulses supplied to the carriage driving pulse motor is incremented, while when moving in a direction back to the home position, the count value of the counter 4 for counting the number of pulses supplied to the carriage driving pulse motor is decremented. Note that this counter 4 is also set in a predefined area of the RAM 216. With the count value, the current position of the recording head 210 can be detected.

After the recording start signal is issued, the recording head 210 is moved from the home position, and upon detection that it arrives at a position corresponding to first column position of the black data, data stored in the print buffer 1 is read each 64 dots in sequence from this position, and latched in the latch circuit 209, whereby the ink discharge heaters of the recording head 210 are driven in accordance with the latched data to effect the recording at the first scan. In a predetermined area of the RAM 216, a counter 3 capable of setting the number of columns corresponding to the width of black data is set, and decremented every time data is read from the first column position where black data exists to make the recording. This counting operation is also made by counting the number of pulse signals corresponding to pulses supplied to the carriage driving pulse motor. And if the count value of this counter 3 becomes 0, the recording head is stopped at that position, considering that the first scan is ended. And the recording paper conveying unit 212 is driven in accordance with the end of the first scan, and the paper conveying (sub-scan) is made by the distance corresponding to the recording width of the recording head 210.

Note that during the recording of data at the first scan, data at the second scan is transferred from the receiver buffer 202 to the print buffer 2 (206), like the data transfer at the first scan, and stored therein. Accordingly, if the data has been stored in the data print buffer 2 (206) at the second scan before the end of the first scan, the print buffer 2 (206) is switched for the reading of data and the print buffer 1 (205) for the storage of data at the end time of the first scan. And like the first scan, data is read from the print buffer 2 (206) to make the recording at the second scan, and the data at the third scan is stored in the print buffer 1 (205).

If data at the second scan is not stored in the print buffer 2 (206) at the time when the first scan ends, the recording head 210 waits for data at the second scan to be placed in the print buffer 2 at the print end position of the first scan. Also, if a preset time (e.g., 2 seconds) has passed on standby, the recording head 210 once returns to the home position. And if data at the second scan is all placed, the print buffer 2 (206) is switched for the reading of data, and the print buffer 1 (205) for the storage of data, whereby data is read from the print buffer 2 (206) to perform the recording at the second scan. Also, during the recording at the second scan, data at the third scan is stored in the print buffer 1 (205). And the paper is fed by the amount corresponding to the recording width of the recording head 210 upon the end of the second scan.

In this way, the print buffers 1, 2 are alternately switched for the data reading (recording) or the data storage, and by repeating the previous operation, the recording for image of one page can be made.

As previously described, the facsimile apparatus in this embodiment predetects that among data stored in the print buffer 1 (205) or 2 (206), the black data exists from which position in what width, and stored in the RAM 216.

Accordingly, after the end of the main scan, and in starting the next main scan, the recording end position at the current scan and the existing range of black data at the next scan are referenced to make the recording of the next scan at the print start position from which the carriage has a shorter travel from the recording end position. Therefore, the high speed printing can be realized without useless movement of the carriage.

However, in the cases where data contains a line extending over two consecutive main scans such as ruled line, the printing is controlled to be made in the same direction, irrespective of the recording end position and the printing range of the next main scan, because if the print direction is reversed every time of the main scan, the ruled line may be deviated.

Also, after the end of communication or when the output of a communication management report from the operation unit 108 is indicated by the user, the CPU1 sends communication management information in character data via the centronics interface to the printer unit 200. In this case, unlike the recording time of received data, the image buffer 104 and the 4-line buffer 107 are not used. In the printer unit 200, received character data is stored in the receiver buffer 202. Data stored in the receiver buffer 202 is read in sequence and analyzed, and then stored in the text buffer 207. Data character stored in the text buffer 207 is expanded into dot image by a character generator, and stored in the print buffer 1 (205) or 2 (206).

The subsequent recording operation is the same as the recording of received image.

The CPU2 of the printer unit 200 controls the recording head 21, the recording paper conveying unit 22 and the recording paper sensor 23 in accordance with an instruction of control command sent from the CPU1 of the facsimile apparatus 100.

Next, the black mark detection timing control in this embodiment will be described below. In the facsimile apparatus in this embodiment as above described, after the end of recording image data of one page, a predetermined pattern (black mark) is recorded at the position a predetermined margin apart from the rear edge in the trailing portion of the recording paper, the image density of this pattern is detected by the photo sensor 13, and the presence or absence of the ink and the conveyance failure of the recording paper are checked in accordance with the detected result. If the emptiness of ink is detected, the memory delayed reception is activated to store the received data following the current page in the image buffer 104. Also, if the conveyance failure is detected, a jam indication appears on the operation unit 108.

Figure 4:
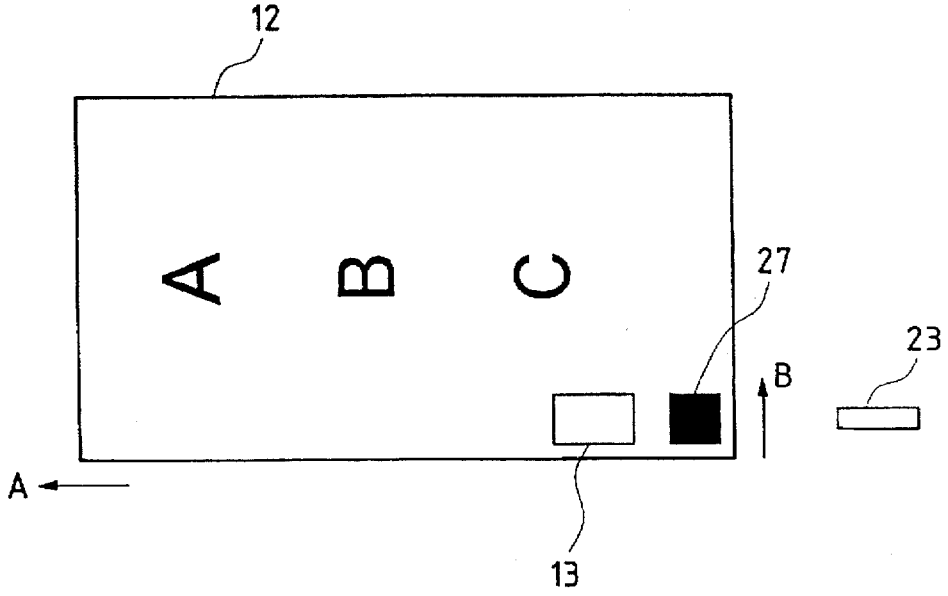
FIG. 4 is a view showing the positional relation between a recording paper sensor and a photo sensor.

FIG. 4 shows the positional relation between the recording paper sensor 23 and the photo sensor 13. Reference numeral 27 indicates the black mark and its recording position. Herein, the sensors 23, 13 and the mark 27 are arranged on the straight line in a direction of conveying the recording paper (A direction or sub-scan direction). Also, they are located at the rearmost end in the recordable range of the recording head 21 upon the recording paper 26.

The output of this photo sensor 13 is input into the CPU1. This predetermined pattern is recorded by sending a print command from the CPU1 to the CPU2 of the printer unit 207, but the CPU1 has a delay from the sending of this print command to the practical recording, and is difficult to know the relative position between the predetermined pattern and the photo sensor 13. Thus, in this embodiment, a signal corresponding to the conveyed position of the recording paper is output from the CPU2 of the printer unit 200 to the CPU1 to allow for the detection of the predetermined pattern at the correct timing.

Figure 5:
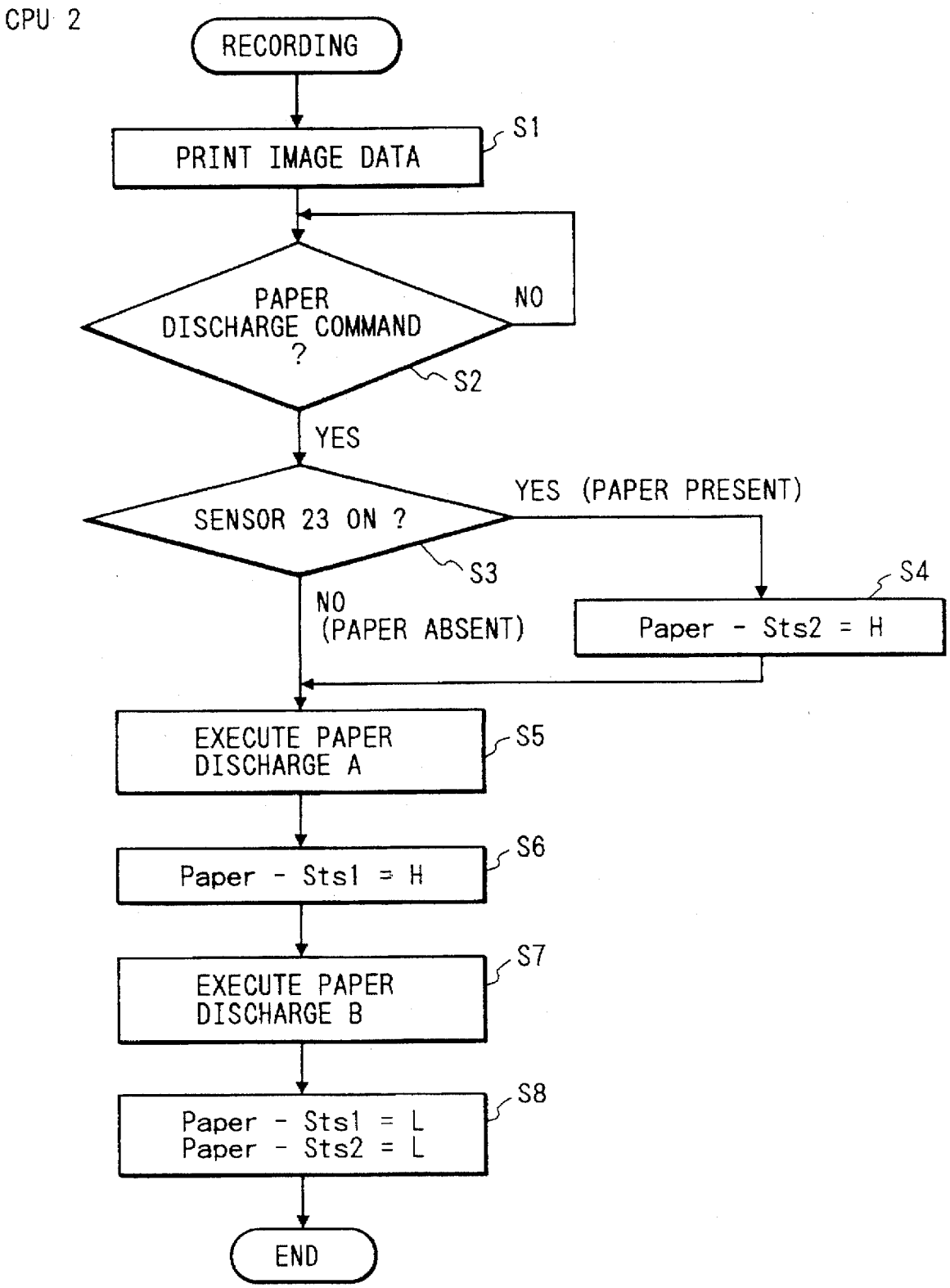
FIG. 5 is a flowchart for explaining a paper ejecting operation control for the recording paper with a control unit of the printer.

FIG. 5 is a flowchart showing the recording operation control of the CPU2 of the printer unit 200. First, at step S1, the CPU2 records data sent from the centronics sender circuit 110 as previously described. At the end of this image data, an image data of black mark 27 as shown in FIG. 4 is transferred to the CPU2, waits for a recording paper ejecting command to be sent and recorded in the trailing portion of the recording paper, like image data. And at step S2, the CPU2 from the centronics sender circuit 110. If the recording paper ejecting command is sent, the state of the recording paper sensor 23 is checked at step S3. Herein, if the recording paper sensor 23 is on (Wherein recording paper is present), the conveyance failure of the recording paper may occur, preventing the normal recording of image, whereby the signal Paper_Sts2 to the CPU1 is set to H. If the recording paper sensor 23 is off (recording paper empty state) at step S3, the operation proceeds to step S5, with the signal Paper_Sts1 remaining at L, considering that the black mark 27 has been recorded at the regular position. At step S5, the paper ejecting operation is executed. In a paper ejecting operation A, the CPU2 performs the conveyance of the recording paper so that the black mark 27 recorded is placed about 10 mm before the photo sensor 13. If the paper ejecting operation A is ended, the signal Paper_Sts1 to the CPU1 is set to H at step S6, to prompt the CPU1 to start the detection of black mark. And the operation proceeds to step S7, with the Paper_Sts1 to the CPU1 remaining at H, to perform a paper ejecting operation B. In the paper ejecting operation B, a further paper ejecting operation is made so that the recording paper is ejected out of the apparatus. And if this paper ejecting operation B is ended, the operation proceeds to step S8 to set the signals Paper_Sts1 and Paper_Sts2 to L, and the end of the paper ejecting operation is informed to the CPU1.

Figure 6:
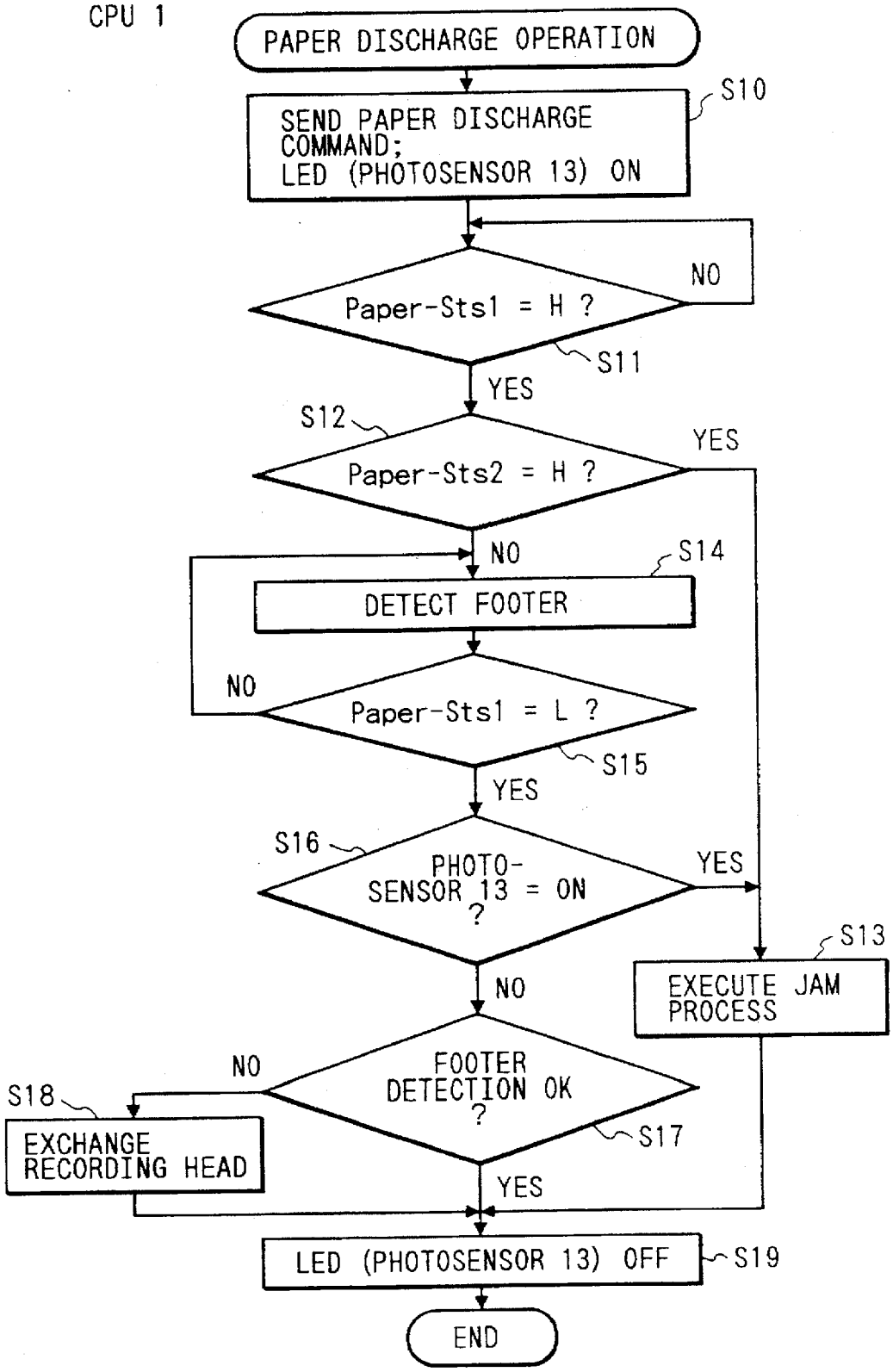
FIG. 6 is a flowchart for explaining a black mark detecting operation control with a control unit of the facsimile main device.

FIG. 6 is a flowchart showing the operation of the CPU1 of the facsimile unit 100 when the CPU2 performs the paper ejecting operation control of the recording paper.

First, at step S10, a paper ejecting command is sent via the centronics sender circuit 110 to the CPU2 of the printer unit 200. At the same time, LED of the photo sensor 13 is turned on. This paper ejecting command is sent from the CPU1 after image data of black mark 27 is sent. And at step S11, the operation waits for the black mark detection start signal Paper_Sts1 to get H. If this black mark detection start signal Paper_Sts1 becomes H, the operation proceeds to step S12 to check for the state of the signal Paper_Sts2 from the CPU2. Herein, if the Paper_Sts2 is H, the CPU2 determines the conveyance failure of the recording paper, and thus the CPU1 does not perform the detection of the black mark, whereby the operation proceeds to step S13 to execute the jam process of the recording paper. This recording paper jam process is a processing of informing the user that the recording paper jam has occurred, specifically by indicating or warning by sound the recording paper jam. At step S12, if the Paper_Sts2 is L, the operation proceeds to step S14 to start the detection of black mark. Herein, the detection of black mark is performed in such a manner as to detect the density at the position of black mark 27 in the recording paper with the photo sensor 13, while the recording paper is being ejected in the paper ejecting operation at step S7 of FIG. 5. The details for the detection of black mark will be described later with reference to FIG. 7. This detection with this photo sensor 13 is continued until the signal Paper_Sts1 becomes L at step S15, that is, the CPU2 terminates the paper ejecting operation of the recording paper as shown in FIG. 3. When the CPU2 terminates the paper ejecting operation, the state of the photo sensor 13 is checked at step S16. Herein, if the photo sensor 13 is on (recording paper present state), the recording paper is not yet exhausted though the CPU2 has terminated the paper ejecting operation. Hence, the operation proceeds to step S13 to execute the jam process for the recording paper, albeit the result of having detected the black mark at step S14. At step S16, if the output of the photo sensor 13 is L, the operation proceeds to step S17 to judge whether or not the detection of black mark at step S14 is normally performed. Herein, if the black mark is normally detected, the operation proceeds directly to step S19 to turn off the LED of the photo sensor 24 and then is ended. At step S17, if the black mark is not detected, the operation proceeds to step S18 to prompt the user to replace the recording head, since the ink is possibly used up with no recording. And the operation proceeds to step S19, where the LED of the photo sensor 13 is turned off and the recording operation is ended.

FIGS. *7a–7c* comprise a chart showing the timing of detecting the black mark.

When a paper ejecting command is received at step S2 of FIG. 5 (X point), the CPU2 performs the paper ejecting operation A. At the time when the recording paper is fed by the amount of (Y-X), the Paper_Sts1 is set to H, and the start of detecting the black mark 27 is instructed to the CPU1. Herein, the black mark 27 is situated about 10 mm before the photo sensor 13 in FIG. 6. After instructing the start of detecting the black mark at Y point, the CPU2 further performs the paper ejecting operation B. The black mark 27 passes by the photo sensor 13 in the (Z-Y), but if the black mark 27 has been normally recorded, the photo sensor 13 outputs a signal of L level while sensing the white paper portion before the black mark 27 in the interval of paper ejection B, a signal of H level while sensing the black mark 27, and a signal of L level while sensing the margin in the trailing portion of the recording paper after the black mark 27. And after the recording paper has passed beneath the photo sensor 13, the photo sensor 13 outputs a signal of H level to sense the black mark of the paper ejecting roller 9. In this series of operations, the CPU1 detects the variation point from H to L (α point) or the variation point from L to H (β point) which is output from the photo sensor 13, while the Paper_Sts1 remains H, and confirms that the photo sensor 13 outputs the H level signal at the time when Paper_Sts1 becomes L (Z point). If these are sensed, it is determined that the recording is normally performed, without recording paper jam. If only the variation point from H to L (β point) is sensed, the emptiness of ink is determined, while if only the variation point from H to L (α point) is sensed, the recording paper jam is determined because the margin in the trailing portion of the recording paper has been sensed at the time of the termination of paper ejection (Z point). Also, if the output of the photo sensor 13 remains at H level in the interval of paper ejection B, the recording paper jam is determined, considering that the recording paper does not come to the paper ejecting roller 9, and the photo sensor 13 continues to sense the paper ejecting roller 9. Also, if the Paper_Sts2 is H in this interval of paper ejection B, the recording paper jam is determined as described with FIG. 5.

In this embodiment, in addition to a normal mode of directly printing the input recording data, a mode referred to as a draft mode of thinning print data in accordance with a certain rule (period) may be provided. This is effective to save the consumption of the ink, shorten the recording period and enable the fast printing as no adjacent dots are discharged continuously, for example, by thinning dots in checked pattern.

When this draft mode is provided, only the black mark may be printed in this draft mode, irrespective of the print mode of image recording. On the contrary, to increase the detecting accuracy of footer mark, only the black mark may be printed in the normal mode to raise the printing density of the mark, even when the draft mode is designated for the image recording.

Another embodiment of printing the footer mark in the normal mode even when the draft mode is set will be further described.

Figure 8:
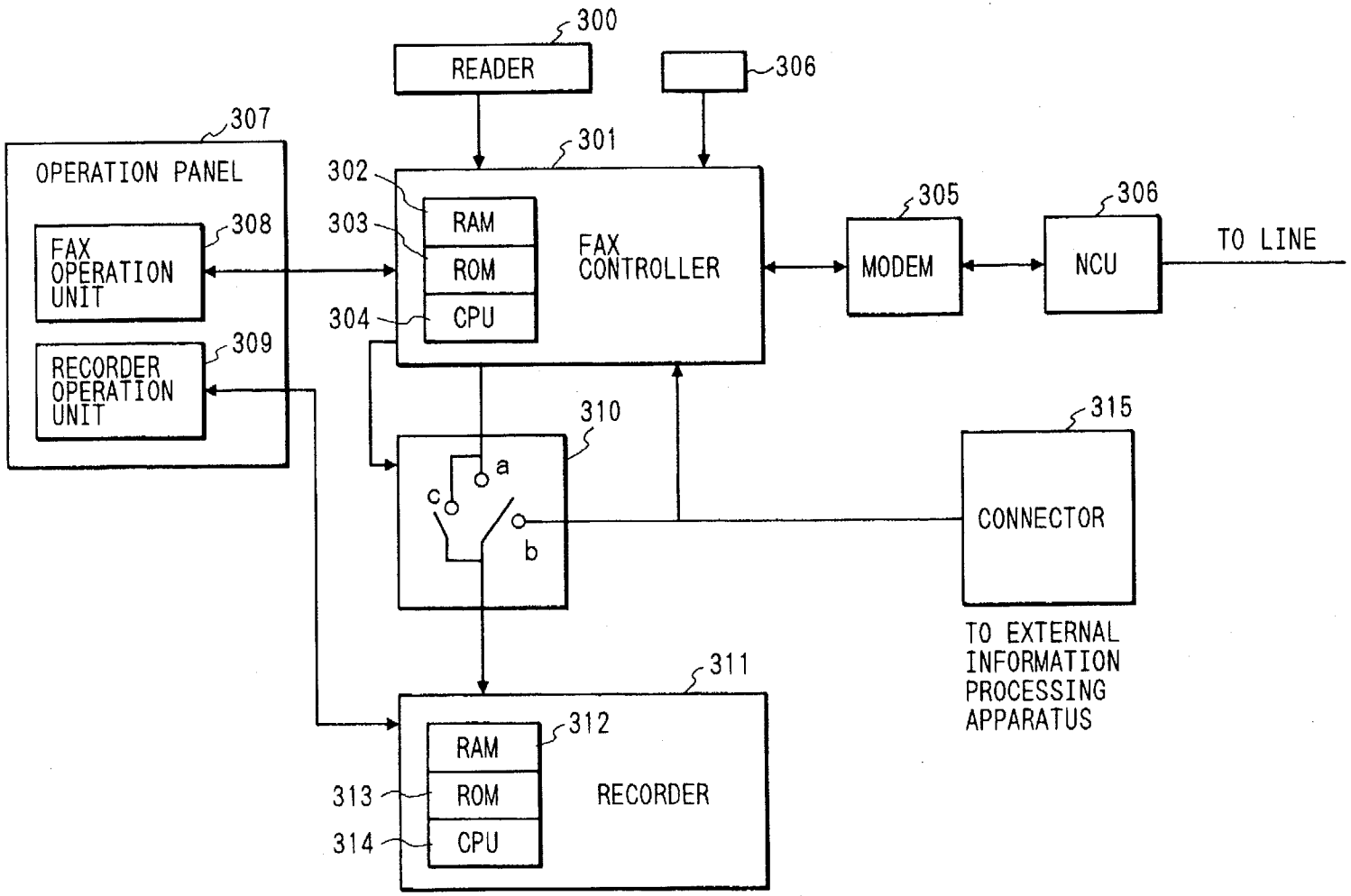
FIG. 8 is a block diagram showing the configuration of a facsimile apparatus to which the present invention is applied.

FIG. 8 shows the configuration of a facsimile apparatus according to this embodiment. In this figure, numeral 301 represents a facsimile control unit constituted of a microprocessor, this facsimile control unit comprising a CPU (Central Processing Unit) 304, a ROM (Read Only Memory) 303, and a RAM (Random Access Memory) 302, to control the image input and output and all the communication processing. The ROM 303 stores a control program, and the RAM 302 is used as a buffer for image data as well as a work area of the CPU 304, and stores set values of the facsimile apparatus which the user sets.

The image input and output is performed by a reader 300 and a recorder 311. That is, the original image data is read by the reader 300 comprised of a CCD (Charge Coupled Device) sensor and an original conveying system. Also, received image data or image data read by the reader 300 for copying is printed on the recording paper by the recorder 311 which is an ink jet printer.

The coupling to a communication line such as a telephone line, and the data input and output are made through a modem 305 and an NCU (Network Control Unit) 306. The NCU 306 is coupled to a telephone for talking in manual control. A facsimile control unit 301 is connected with a photo sensor 406 as hereinafter described to judge whether or not the ink is present based on a footer mark detected result of the photo sensor 406.

The recorder 311 is comprised of an ink jet head, recording paper conveying means and control means. The control means comprises a CPU 314, a ROM 313 for storing a control program for the CPU and a character generator, and a RAM 312 used for a work area, a command buffer and a print buffer.

Reference numeral 310 is a switch for switching data input into the recorder 311, switched under control of the facsimile control unit 301. If switched to the a side, it passes received data of the facsimile apparatus to the recorder and printed. If switched to the b side, it passes print data from an external information processing apparatus connecting to a connector 315 to the recorder for the printing. Also, if switched to the b side, it is also joined to the c side at the same time. Thereby, a command from the connector 315 is entered into the switch 310, as well as the facsimile control unit 301, whereby the facsimile control unit 301 can know that the command is sent via the connector 315 to the recorder, when the switch is switched to the b side.

That is, the recorder 311 has two operation modes. One mode is for recording received image of facsimile or copied image (hereinafter referred to as a facsimile mode), and the other is for recording data from the external information processing apparatus (hereinafter referred to as a print mode).

An operation panel 307 is provided with a FAX operation unit 308 and a recorder operation unit 309. The FAX operation unit 308 has a ten-key for the input of a telephone number, various function keys, an operation mode key for switching the operation mode between a facsimile mode and a print mode, and a display for use in displaying the telephone number and the time. The recorder operation unit 309 has a display for displaying the current operation mode or print mode.

The recorder 311 used in this embodiment employs an ink jet recording apparatus, as previously described, the recording head of which is a recording head of the ink jet system, having 64 nozzles, for discharging the ink through discharge orifices at the nozzle top end owing to a pressure of film boiling caused in the ink by the heating of electricity-heat converters provided within the nozzles. The recording head is of the cartridge type which is integrated with an ink tank, and replaceable with a new one as a whole when the ink is exhausted.

Figure 9:
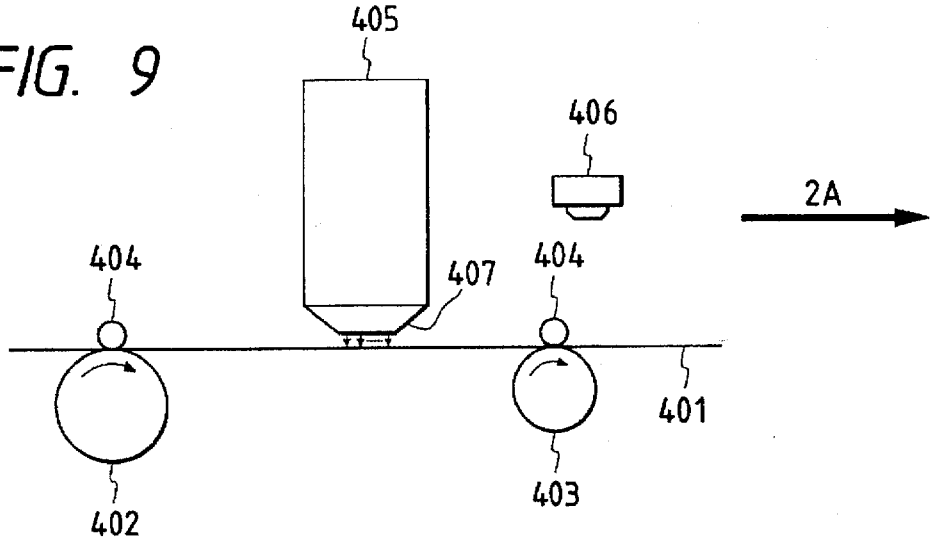
FIG. 9 is a view showing the principal constitution of a recorder.

FIG. 9 shows the constitution of a main part of the recorder. In FIG. 9, a recording paper 401 is conveyed in a direction of arrow 2A up to a print position by a paper feed roller 402 and a paper presser roller 404. The recording head 407 of the cartridge 405 is reciprocated in the vertical directions to the paper face to perform the printing in a main scan direction, and concurrently perform the printing in a width of 64 nozzles in a sub-scan direction. Every time the main scan is terminated, the paper feed roller 402 and a paper ejecting roller 403 are driven by a drive system, not shown, to convey the recording paper 401 in the sub-scan direction by the distance corresponding to a recording width at high precision. By repeating this main scan and the paper feed (sub-scan), one page of image recording can be performed. Reference numeral 406 is a reflection-type photo sensor for sensing optically whether or not there is a predetermined pattern (black mark) printed on the trailing portion of the recording paper after one page of image recording. Based on a sensed result of the photo sensor 406, it is possible to determine the emptiness of ink in the recording head 405 or the recording paper jam from the output of black mark or the white output of the recording paper. The photo sensor for use in this embodiment judges whether the range 3 mm in diameter is white or black, using a red LED as the light emitting element and a phototransistor as the light receiving element.

Figure 10:
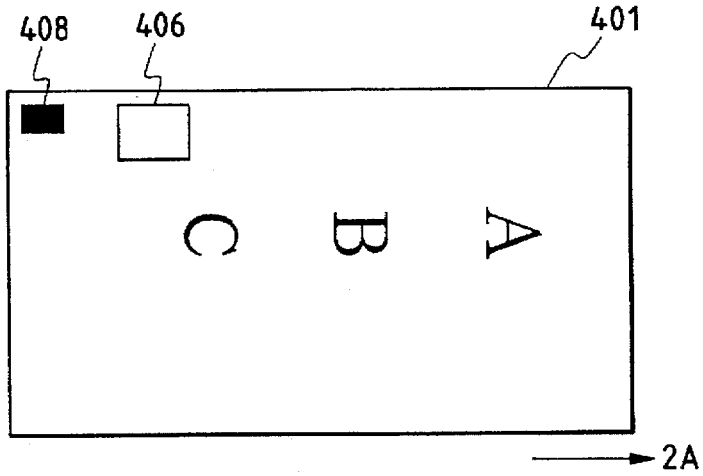
FIG. 10 is a view for explaining the positional relation between a footer mark and a photo sensor.

FIG. 10 shows the positional relation of the photo sensor 406 on the recording paper, wherein 408 is a footer mark for the detection of ink remains and its recorded position. Herein, the photo sensor 406 and the mark 408 are arranged on one straight line. These are disposed on the left end side in a recordable range of the recording head 407 upon the recording paper 201. Further, the footer mark recording position is set so that a white portion of the recording paper having a predetermined length is always left in the trailing portion of the recording paper 401 when recording the footer mark.

Accordingly, the facsimile control unit 301 can determine that the footer mark has been normally recorded if the photo sensor 406 senses black followed by white, and the ink is present.

Next, the print mode of the facsimile apparatus in this embodiment will be described.

Figure 11A:
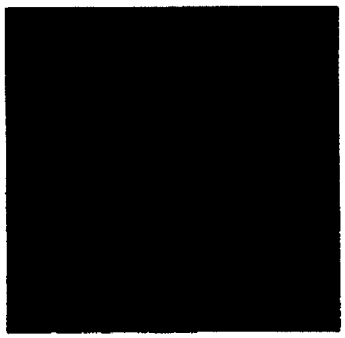
FIGS. 11A and 11B are views showing print examples in a standard print mode and a thinning print mode.
Figure 11B:
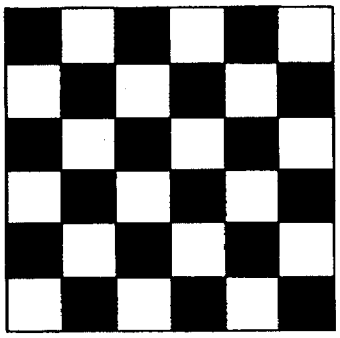

FIG. 11A shows a standard print mode of printing without thinning out the black dot data. Also, FIG. 11B shows a thinning print mode of printing in a block by thinning out the black dot data at a fixed interval, thereby suppressing the discharge amount of the ink. As previously described, the presence or absence of the ink can be judged through optical sensing with the photo sensor, in which there may possibly occur such instances that, when printed in the thinning print mode (FIG. 11B) as shown, the black or ink presence is judged erroneously as the white or ink absence due to changes in the sensor performance. To eliminate such erroneous judgements, only a mark for sensing the presence or absence of the ink (hereinafter referred to as a footer mark) is necessary to print in the print mode (FIG. 11A) having higher density. However, there is a high frequency that the recording apparatus prints data having considerably higher black ratio. If the user is only permitted to use the standard print mode (FIG. 11A) to print data, the more amount of ink is consumed correspondingly, requiring the cartridge to be replaced in a shorter period. Thus, in this embodiment, the standard print mode or the thinning print mode can be selected at will in accordance with the needs of the user, and the footer mark is printed only in the standard mode regardless of whichever mode may be selected. Thereby, data having higher black ratio is printed in the thinning print mode (FIG. 11B), and the footer mark is printed in the standard print mode (FIG. 11A), so that the ink consumption can be saved.

Of course, under control of the print operation of the recording apparatus, the print mode can be arbitrarily selected by the user with a key on the operation panel 307. This selection between the standard mode and the thinning mode can be made individually in either of the facsimile mode and the printer mode. Also, the selection of whether or not the presence or absence of the ink is judged can be arbitrarily set by the user with a key on the operation panel 307. With these settings, if the emptiness of ink is judged in the facsimile mode, for example, there is a possibility that the emptiness of ink has occurred during the recording of one page, for which received data following that page is stored in the memory, and the received data can be printed again, if the cartridge is replaced with a new one by the user. Also, when used for the facsimile apparatus as shown in this embodiment or the external information processing equipment, this recording apparatus can make the control to display an indication or light a warning LED for informing the user of the emptiness of ink on the operation panel 307.

Figure 12:
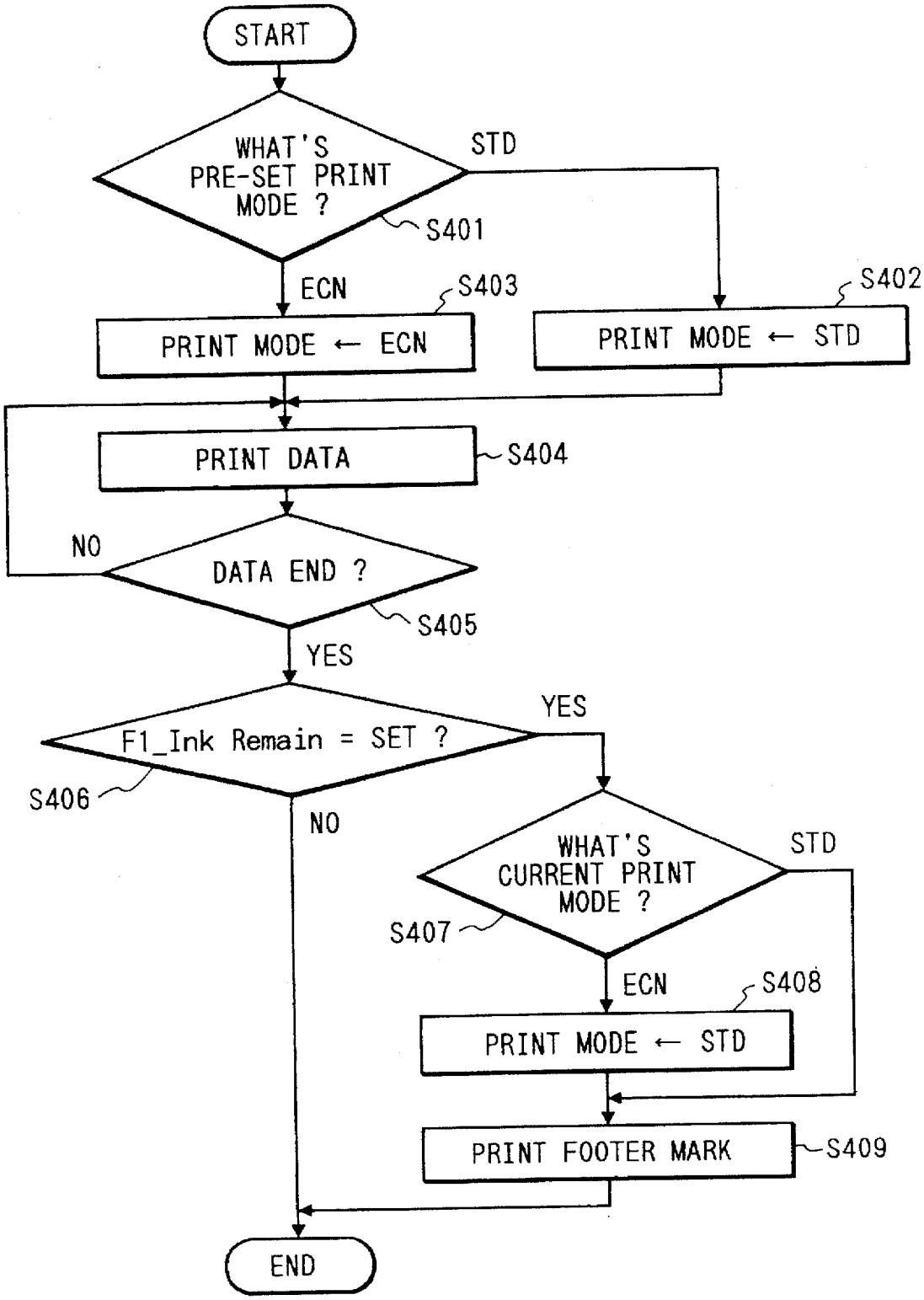
FIG. 12 is a control flowchart of printing.

FIG. 12 is a control flowchart of a printing operation which the CPU 304 of the recorder performs. In accordance with a print mode preset by the user, the operation transfers to that print mode at S401. In this embodiment, there are provided two print modes including a standard print mode STD (standard printing) which has a standard print quality as the print mode, and a thinning print mode ECN (economy printing) with the discharge of ink suppressed below that of STD. At S402 and S403, the CPU 304 of the recording apparatus is set to a selected print mode. At S404, received data is printed in accordance with the print mode. At S405, the printing is performed in the set print mode until the end of data. Also, in a setting where the user determines whether or not the ink is present, a flag F1_InkRemain is preset at a predetermined location within the RAM 302. Herein, if data of one page is all printed, a check is made to see whether or not the flag F1_InkRemain is set at S406, whereby if the flag F1_InkRemain is RESET, the operation is terminated immediately, but if the flag F1_InkRemain is SET, the current print mode is confirmed at S407. If the current print mode is STD, the footer mark is printed at S409, and then the print operation is completed. On the other hand, if the print mode is ECN at S407, the print mode of the recording apparatus is set to STD anew at S408, the footer mark is printed in the print mode STD at S409, and the print operation is completed. In this embodiment, the footer mark is printed after the printing of print data, but practically, wherever the footer mark is printed on the recording paper, it is only necessary to set anew the print mode in the recording apparatus immediately before printing of the footer mark, and then print the footer mark.

In this embodiment, in an ink jet recording apparatus having a plurality of print modes which can be used as the recording apparatus for the facsimile or external information processing equipment, the print mode can be selected according to the needs of the user, whereby the ink consumption can be saved, as necessary, and the running cost of the user can be reduced. Also, without regard to the print mode used, the mark for judging the presence or absence of ink is printed only in the standard print mode, whereby the erroneous judgement for the presence or absence of ink can be eliminated.

As to the representative constitution and principle of such ink jet recording method of forming flying liquid droplets using heat energy for the recording, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure waves of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specification or the constitution as one recording head integrally formed may be used.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a recovery means for the recording head, a preliminary auxiliary means, etc., provided for the recording head is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary discharge mode which performs discharging separate from recording.

Though the ink is considered as a liquid in the embodiments as above described, another ink may be also usable which is solid below room temperature and will soften or liquefy at or above room temperature, or liquefy when a recording signal used is issued as it is common with the ink jet recording system to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as those liquefying with the application of heat energy in accordance with a recording signal so that liquid ink is discharged, or may be solidifying at the time of arriving at the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The film boiling method can be implemented most effectively for the inks as above cited.

Also, the present invention is applicable not only to the ink jet system using heat energy but also to the ink jet system using the piezoelectric element.

Furthermore, while the facsimile apparatus has been exemplified in this embodiment, it will be understood that the present invention is not limited thereto but also applicable to a printer connected to a host system, or a copying machine with a reader.

What is claimed is:

1. An image recording apparatus having a first recording mode of recording with a means for recording an image on a recording medium at a predetermined recording density, and a second recording mode of recording with the recording means an image on the recording medium at a lower recording density than said first recording mode, the image recording apparatus comprising:

selecting means for selecting said first recording mode or said second recording mode;

recording control means for controlling the recording means to record a predetermined image on the recording medium after recording of a predefined amount of image in said first recording mode or said second recording mode which is selected by said selecting means;

detecting means for detecting said predetermined image; and processing means for performing a predetermined process based on a detected result of said detecting means;

wherein said recording control means controls the recording means to record said predetermined image in said first recording mode, without regard to the recording mode selected by said selecting means.

2. An image recording apparatus according to claim 1, wherein said first recording mode is a mode of recording black dot data without thinning, and said second recording mode is a mode of recording black dot data by thinning in a predetermined manner.

3. An image recording apparatus according to claim 1 or 2, further comprising reception means for receiving image data sent from a sending side, wherein the image data received from said reception means is recorded in said first recording mode or said second recording mode.

4. An image recording apparatus according to claim 1 or 2, further comprising said recording means, wherein said recording means records the image by discharging the ink.

5. An image recording apparatus according to claim 4, wherein said predetermined image comprises a mark having a specified recording density.

6. An image recording apparatus according to claim 5, wherein said detection means comprises a light emitting portion for emitting light to said mark, a light receiving portion for receiving the light from said mark, and outputting a signal in accordance with the quantity of light received, and judging means for judging the presence of ink based on the signal from said light receiving portion.

7. An image recording apparatus according to claim 6, wherein said processing means comprises display means for displaying a predetermined indication in accordance with an output of said judging means.

8. An image recording apparatus according to claim 4, wherein said recording means discharges the ink by causing state change in the ink using heat energy.

* * * * *

UNITED STATES PATENT AND TRADEMARK OFFICE

CERTIFICATE OF CORRECTION

PATENT NO. : 5,689,289 Page 1 of 2

DATED : November 18, 1997

INVENTOR(S) : Naoya WATANABE, ET AL.

It is certified that error appears in the above-identified patent and that said Letters Patent is hereby corrected as shown below:

ON THE COVER PAGE

AT [57] ABSTRACT:

Line 3, "means" should be deleted.

COLUMN 2:

Line 22, "comprises is" should read --comprise--.

COLUMN 6:

Line 47, "drives" should read --driver--.

COLUMN 8:

Line 62, "(Wherein" should read --(wherein--.

UNITED STATES PATENT AND TRADEMARK OFFICE

CERTIFICATE OF CORRECTION

PATENT NO. : 5,689,289 Page 2 of 2

DATED : November 18, 1997

INVENTOR(S) : Naoya WATANABE, ET AL.

Figures 7A, 7B, 7C:
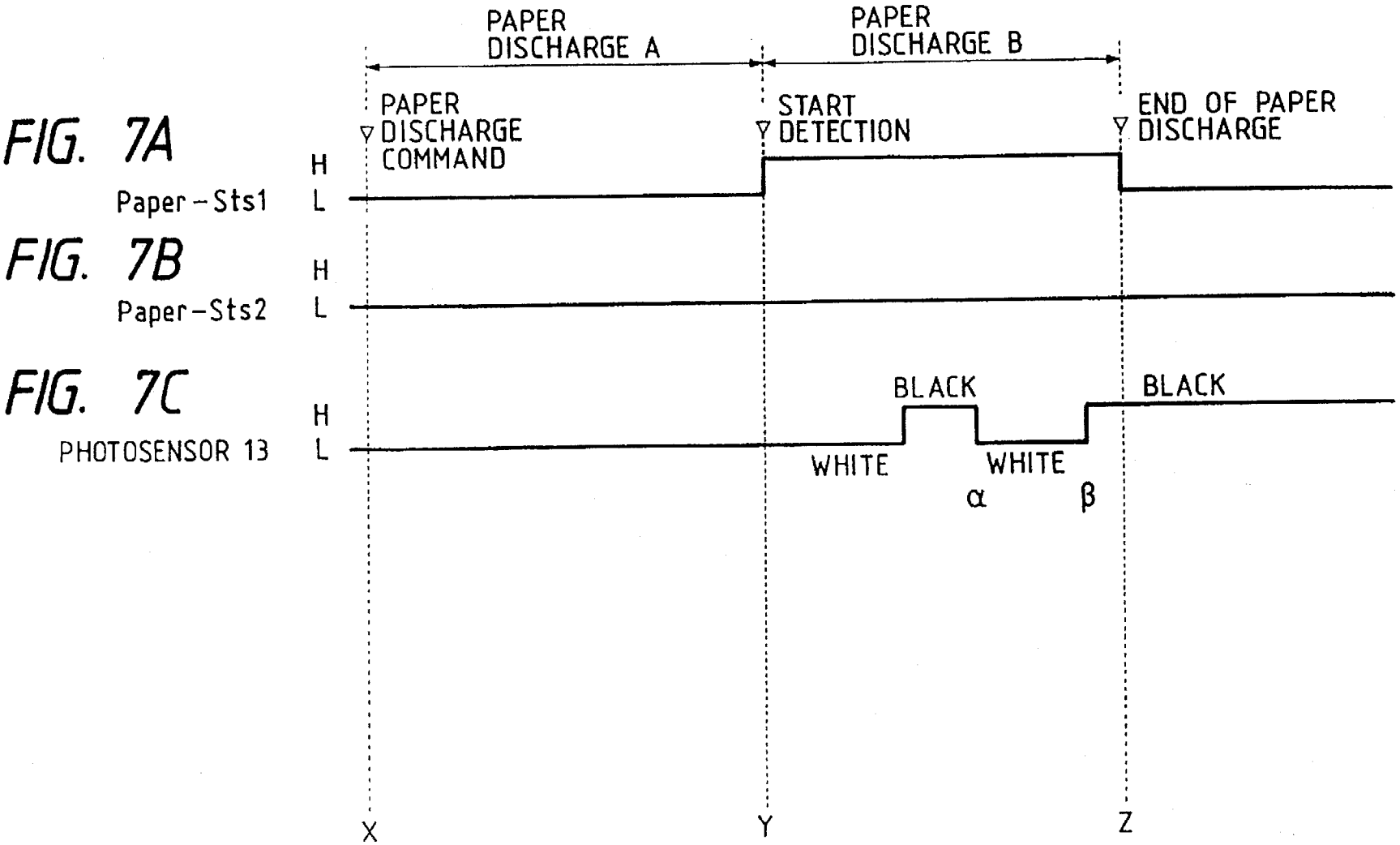
FIGS. 7A–7C comprises is a timing chart for detecting the black mark.

It is certified that error appears in the above-identified patent and that said Letters Patent is hereby corrected as shown below:

COLUMN 10:

Line 1, "FIGS. 7a-7c" should read

--FIGS. 7A-7C--.

Signed and Sealed this

Sixteenth Day of June, 1998

*Attest:*

*Attesting Officer*

BRUCE LEHMAN

*Commissioner of Patents and Trademarks*